United States Patent [19]

Steiner et al.

[11] Patent Number: 4,822,533

[45] Date of Patent: Apr. 18, 1989

[54] HUMIDIFIER WITH FLOATING WICK ASSEMBLY AND REPLACEABLE WICK ELEMENTS

[75] Inventors: Robert E. Steiner; Terrence L. Stanek, both of St. Louis County, Mo.

[73] Assignee: Emerson Electric Co., St. Louis, Mo.

[21] Appl. No.: 156,598

[22] Filed: Feb. 17, 1988

Related U.S. Application Data

[63] Continuation-in-part of Ser. No. 940,444, Dec. 11, 1986, abandoned.

[51] Int. Cl.[4] ..... B01F 3/04

[52] U.S. Cl. ..... 261/72.1; 261/120; 261/104; 261/DIG. 46

[58] Field of Search ..... 261/120, DIG. 46, 104, 261/72.1; 55/521

[56] References Cited

U.S. PATENT DOCUMENTS

| | | | |
|---|---|---|---|
| Re. 31,675 | 9/1984 | Vesper . | |
| 182,345 | 9/1876 | Bickford . | |
| 353,311 | 11/1886 | Keller . | |
| 362,197 | 5/1887 | Bennett . | |
| 629,581 | 7/1899 | Martenette . | |
| 701,890 | 6/1902 | Keller . | |
| 828,334 | 8/1906 | Peterson . | |
| 951,590 | 3/1910 | Brown . | |
| 1,064,102 | 6/1913 | Smith et al. . | |
| 1,447,336 | 3/1923 | Baughman . | |
| 1,912,480 | 9/1932 | Houlis . | |
| 2,031,055 | 2/1936 | McKinney . | |
| 2,118,695 | 5/1938 | Bahnson . | |
| 2,377,527 | 6/1945 | Siefken . | |
| 3,045,450 | 7/1962 | Chandler . | |
| 3,188,007 | 6/1965 | Myklebust . | |
| 3,220,707 | 11/1965 | Weatherston et al. . | |
| 3,283,478 | 11/1966 | Katzman et al. . | |
| 3,287,002 | 11/1966 | Sevald | 261/120 |
| 3,290,021 | 12/1966 | Blackly et al. . | |
| 3,294,376 | 12/1966 | Eranosian . | |
| 3,306,010 | 2/1967 | Garofalow et al. . | |
| 3,348,821 | 10/1967 | Martin et al. . | |
| 3,348,822 | 10/1967 | Vieceli et al. . | |
| 3,552,097 | 1/1971 | Grasseler . | |
| 3,552,725 | 3/1969 | Ray . | |
| 3,782,081 | 1/1974 | Munters . | |
| 3,864,437 | 2/1975 | Blaszkowski . | |
| 3,914,349 | 10/1975 | Stipanuk . | |
| 3,953,551 | 4/1976 | Dorall . | |
| 4,051,205 | 9/1977 | Grant . | |
| 4,147,524 | 4/1979 | Smith et al. | 55/521 |
| 4,217,315 | 8/1980 | Keeler, II | 261/120 |
| 4,222,971 | 9/1980 | Eilert . | |
| 4,226,174 | 10/1980 | Vesper . | |
| 4,301,094 | 11/1981 | Baus . | |
| 4,350,646 | 9/1982 | Baus . | |
| 4,362,090 | 12/1982 | Whiteley . | |
| 4,448,593 | 5/1984 | Spiers . | |
| 4,610,706 | 9/1986 | Nesher . | |
| 4,698,188 | 10/1987 | Gutmann | 261/120 |
| 4,699,737 | 10/1987 | Engstrand | 261/120 |

FOREIGN PATENT DOCUMENTS

| | | | |
|---|---|---|---|
| 54100 | 1/1938 | Denmark | 261/104 |
| 3312367 | 10/1984 | Fed. Rep. of Germany . | |

*Primary Examiner*—Tim Miles

*Attorney, Agent, or Firm*—Polster, Polster and Lucchesi

[57] ABSTRACT

A room humidifier is disclosed having a floating wick assembly having wick elements, the wick assembly floating on a water supply thereby to maintain a constant water depth and evaporative area on the wick element as the water level within the humidifier rises and falls. The wick element is formed of a web of non-woven, fibrous material (e.g., a paper-like material) which draws water by capillary action from the reservoir onto the evaporative area of the wicking element from when water is evaporated into the air drawn through the wicking element by a fan for discharge into the room. The wick element may readily be removed from the wick assembly for cleaning or replacement.

9 Claims, 5 Drawing Sheets

HUMIDIFIER WITH FLOATING WICK ASSEMBLY AND REPLACEABLE WICK ELEMENTS

CROSS REFERENCE TO A RELATED APPLICATION

This is a continuation-in-part application of Ser. No. 940,444, filed Dec. 11, 1986, now abandoned.

BACKGROUND OF THE INVENTION

This invention relates to a humidifier with a floating evaporative wick with replaceable wick elements or cartridges having a constant area evaporative surface on its wicking elements.

Generally, room humidifiers are utilized to add moisture to dry air within a room being heated so as to maintain the relative humidity in the room within a desired comfort range. As is widely recognized, during the winter heating season, humidity levels within heated rooms tend to be quite low because the moisture content of the outside air is low such that when the atmospheric air is heated, low relative humidities within a room result. Low relative humidity causes excessive static electricity, discomfort to the occupants of the room, drying out furniture and plants, and numerous other problems.

Heretofore, room humidifiers were generally of a variety of types. In a first type, water was sprayed onto an evaporative filter by means of a pump and air was then drawn through the pad for evaporating the water sprayed thereon and for discharging the humidified air into the room. Reference may be made to U.S. Pat. No. 3,914,349, which discloses such a humidifier. As is typical, the pumps for such humidifiers consisted of a vertically disposed centrifugal impeller which picked up water from a water reservoir and which sprayed the water radially outwardly onto the inner surface of the pad surrounding the pump. Air would then be forced by the fan through the pad so as to cause the evaporation of the water. However, these humidifiers typically required a water level control so as to maintain a relatively constant supply of water being fed to the pump. Alternatively, other humidifiers were known which had variable evaporative areas on their pads, thus resulting in variable rates of water evaporation and humidification depending on the exposed evaporative area. Other examples of such centrifugal pumps/evaporative filter humidifiers may be seen by referring to U.S. Pat. Nos. 3,220,707, 3,294,376, 3,348,821, 3,348,822, 3,552,097, 3,953,551, 4,301,094, and 4,350,646.

Other humidifiers were known in which a wicking or evaporative element was at least in part submerged in a water bath and in which air was blown over the wetted wicking element so as to evaporate water therefrom. However, such immersed filter or wicking element humidifiers required a separate reservoir or water supply which fed water to an evaporative sump by means of a float control valve thereby to maintain a substantially constant water level wetting the evaporative pad. Reference may be made to U.S. Pat. No. 2,031,055 for a more complete disclosure of such a humidifier.

Still further, other humidifiers were known which utilized a motor driven belt evaporative pad or wicking element which was entrained around rollers and which extended into a water reservoir for wetting the evaporative belt or pad. The wetted belt then rose out of the water supply and room air was forceably drawn over the belt thereby to evaporate water therefrom and to humidify the air.

A number of long-standing problems have been associated with all of the above-described types of room humidifiers. With centrifugal pump/filter humidifiers, the combination of the required pump and fan added substantially to the mechanical complexity and cost of the unit. The centrifugal pump oftentimes had a tendency to clog with mineral deposits. In addition, in order for the filter/evaporative pad to have a constant surface area, it was often necessary to have a separate water supply tank feeding water to the pump by means of a control valve which maintained a constant water level at the pump inlet. Again, this added to the complexity and cost of the unit and, due to mineral deposits, required that these parts be periodically cleaned to maintain them in a workable condition over extended periods of time. Further, the filter/evaporative pads of these centrifugal pump-type humidifiers experienced mineral build-up thereon which in turn required replacement or cleaning. However, it was a relatively difficult and expensive matter to remove and replace these clogged filter/evaporative pads.

In humidifiers both of the fixed evaporative pad construction and of the movable belt pad construction, several additional problems have long been noted. First, in regard to the fixed pad evaporative unit, such as shown in U.S. Pat. No. 2,031,055, the evaporative efficiency of such humidifiers is oftentimes dependent on the capillarity capabilities of the evaporative pad and the area of the pad in contact with the water supply. It will be appreciated that as the water is drawn up from the water supply and evaporated from the pad, mineral deposits, both soluble and insoluble deposits, remain on the pad, thus significantly decreasing its surface area and its evaporative efficiency. Additionally, these mineral deposits tend to diminish the capillarity characteristics of the evaporative pad. Thus, the pads must be periodically cleaned or replaced which is a rather cumbersome job.

In regard to the rotary belt humidifiers in which an endless belt is entrained around rollers to pass through a water supply and then to be exposed to moving air for evaporating water picked up thereon, it will be appreciated that mineral deposits will also remain on the belt. However, because the belt continuously passes through the water, soluble salts and other soluble deposits will be redissolved into the water supply. Additionally, movement of the belt being entrained around a roller disposed below the level of the water supply tends to dislodge insoluble mineral deposits. Because the soluble deposits from the belt are again dissolved in the water supply, this has the effect of substantially increasing the concentration of these soluble minerals in the water supply. Thus, over time, as the concentration of these soluble mineral deposits accumulates in the water supply and as the insoluble mineral deposits build up on the bottom of the water supply tank or reservoir, the increased concentrations of the soluble dissolved minerals in the supply water will be carried onto the movable evaporative pad and will be deposited thereon in relatively high concentrations so as to markedly reduce the evaporative efficiency of the pad. Thus, in such rotary belt humidifiers, it is required that the belt pads be periodically replaced which is a time-consuming job requiring substantial disassembly of the humidifier.

Also, because of the above-noted increased concentrations of minerals in the supply water, certain of these precipatate out of solution and form a thick coating on all parts of the humidifier below the water level. Removal of these mineral deposits is difficult. Certain "anti-scale" chemical additives are oftentimes used to combat such buildup, but these "anti-scale" chemical additives merely turn the hardened crust into or gel still leaving a difficult cleanup job.

U.S. Pat. No. 3,864,437 and German Patent No. 3,312,367 disclose humidifiers which have floating evaporative pads, they either utilize complicated accordion-like sidewalls or bellows, to direct air flow between the fan and the evaporative fan, or blow unducted air downwardly on a pad.

There has been a long-standing need for a portable room humidifier which maintains a constant evaporative area on the wicking or filter pad without the requirement of complicated float valves and the like to maintain a constant water level. There has also been a long-standing need for a humidifier in which the evaporative wicking pad may be readily removed for cleaning or replacing thereby to maintain the evaporative efficiency of the humidifier within a desired range. There has also been a long-standing need for an evaporator which eliminates the necessity of a centrifugal pump, and yet which does not necessitate the use of complicated float control valves, and which does not increase the concentration levels of soluble minerals dissolved in the water supply.

SUMMARY OF THE INVENTION

Among the several objects and features of the present invention may be noted the provisinn of a portable room humidifier which has no requirement for float control valves, pumps, rotary drums, rotary belts, or any other mechanically driven member except the blower fan;

The provision of such a humidifier in which the evaporative wicking elements are carried by a tray floatable on the water supply thereby to maintain the wicking elements in operative communication with the water, and to maintain a constant evaporative area on the pads, regardless of the water level of the water supply within the humidifier;

The provision of such a humidifier in which both soluble and insoluble mineral deposits remain on the wicking element or evaporative pad, and in which the evaporative pad may be readily, periodically removed from the humidifier for cleaning or replacement thus preventing excessive concentrations of soluble minerals in the water supply and preventing accumulations of solid particles of insoluble mineral deposits in the humidifier (except on the wicking element);

The provision of such a humidifier in which no hand tools or no substantial amount of disassembly is required for removal and replacement of the evaporative pads;

The provision of such a humidifier having a wicking element formed of a unitary web of felt-like or paper-like material for absorbing water from a water supply and for transferring the water therethrough by capillary action to the evaporative area of the wicking element for surface evaporation therefrom;

The provision of such a wicking element in which the wicking medium thereof is of one-piece construction, which has a high surface area in relation to its size, and which can be made with a minimum amount of labor and cost;

The provision of such a humidifier having a simplified duct structure to insure the flow of dry air through the floating evaporative pad to the fan, regardless of the depth of the water in the humidifier;

The provision of such a wicking element in which a hardenable liquid-like material (e.g., a hot-melt adhesive) is applied to the edges of its wicking medium thereby to hold various layers of the wicking medium in desired spaced relation relative to one another without the necessity of interfitting each of the edges of the wicking medium to be held to a spacing member; and The provision of such a humidifier which is of low cost, which is reliable in operation, which has a minimum number of moving parts, which requires a minimum amount of service, and which is of quiet and reliable operation.

Other objects and features of this invention will be in part apparent and in part pointed out hereinafter.

Briefly stated, a humidifier of the present invention comprises a water reservoir tank for holding a supply of water. An evaporator is floatable on the water in the tank, with the evaporator having a wicking element in operative association with the water and having an evaporative surface extending above the level of the water. The humidifier further comprises a fan and a flow path between the wicking element and the fan so that the fan may move air over the evaporative surface of the wicking element for evaporating water therefrom and for discharging humidified air from the humidifier. In one embodiment of the invention, the flow path is constituted by telescopically walls carried by the humidifier and the float which slidingly, sealably engage one another together with the rise and fall of the water level within the tank.

This invention also relates to a wicking element for a humidifier which has a core of sheet wicking material, the core comprising a plurality of sheets arranged generally parallel to one another in spaced apart relation. The sheets extend vertically when the filter element is installed in a humidifier, with the lower margins of the sheet immersed in water, and with the portions of the sheets extending above the water constituting, at least in part, an evaporative area of the wicking element. Optional diagonal ribs may be interposed between each of the parallel sheets so as to increase the surface area of the wicking element. Still further, spacers of a hardenable liquid, such as a hot-melt adhesive, may be applied to the edges of the plates and the ribs so as to hold the plates and ribs in desired spaced relation to one another upon hardening of the liquid material.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
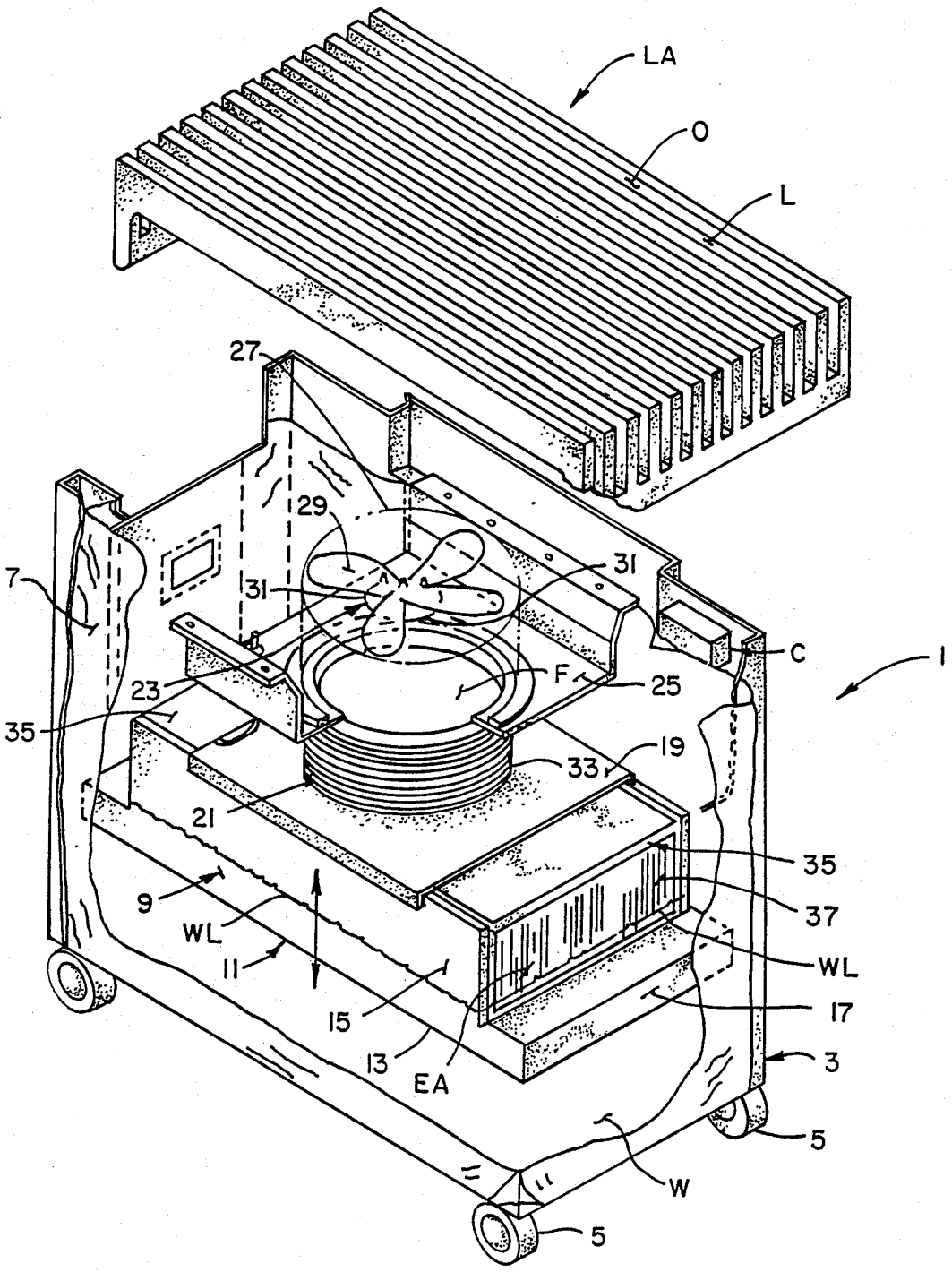
FIG. 1 is an exploded perspective view of a portable room humidifier of the present invention with parts thereof broken away for the purposes of illustration.

Referring now to the drawings, a portable room humidifier of the present invention is indicated in its entirety by reference character 1. More specifically, humidifier 1 includes a reservoir tank 3 for holding a supply of water W, with the reservoir tank being mounted on casters 5 such that the humidifier may be readily rolled to any desired location within a room. As indicated at 7, an optional disposable liner may be provided within reservoir tank 3 for containing the supply of water. More specifically, disposable liner 7 is preferably a bag formed of a suitable plastic film or the like which is fixed to the side walls and bottom of tank 3 and which conforms to the inner shape of the tank. Of course, the water will be contained within liner 7 and in such manner, the liner, substantially empty of water, may be readily removed from the tank and discarded thereby to facilitate cleaning of humidifier 1. Of course, a new liner may be readily installed and filled with water for continued operation of the humidifier.

Humidifier 1 further includes a floating wick assembly, as generally indicated at 9. This floating wick assembly includes a wick frame 11 having a base 13, side walls 15, and end walls 17 extending up from the base and forming a floatable tray or vessel having its bottom at least in part immersed within the water contained within reservoir tank 3, with the majority of wick assembly 9 extending up above water level WL for purposes as will appear. The wick assembly further has a top wall 19 having a central outlet opening 21 therewithin. In this manner, the floating wick assembly defines a portion of a flow path F extending from a position above water level WL at the end walls 17, within wick frame 11 between side walls 15 and below top 19 to central opening 21.

As generally indicated at 23, a fan is carried by a frame 25 which is stationarily mounted with respect to reservoir tank 3, generally directly above central outlet opening 21 in top wall 19. Fan 23 includes a venturi 27 having a plurality of fan blades 29 mounted therein and driven by a suitable electric motor 31. It will be understood that within the broader aspects of this invention, fan motors and blades of various configurations, whether mounted in a venturi or not, may be utilized with the humidifier of the present invention. An extensible/collapsible duct 33 is sealably secured to top wall 19 and surrounds outlet opening 21 therewithin. Duct 33 extends up to the bottom of frame 25 thereby to constitute a portion of the flow path F between floating wick assembly 9 and fan 23. Preferably, duct 33 has a flexible wire coil duct frame covered with flexible air impervious sheet or film material. The duct is somewhat larger than the maximum distance between frame 25 and top wall 19 when the evaporator is at its lowermost position within tank 3. This extensible/collapsible duct 33 permits the floating wick assembly to rise and fall with the level of water WL within reservoir tank 3 substantially without interference and yet constitutes a portion of flow path F through the wicking assembly 9 to fan 23. It will be understood that the floating wick assembly 9 is sized relative to the interior dimensions of reservoir tank 3 such that the floating wick assembly may readily rise and fall within the tank as the water level rises and falls, but the floating wick assembly is substantially held against rotation with respect to the tank. A removable louver assembly LA having longitudinal openings O between the fixed louvers L is fitted to the upper margins of tank 3. Fan 23 draws room air into tank 3 through the end portions of the louver assembly LA, and humidified air is exhausted by fan 23 through the center portion of the louver assembly into the room thereby to increase the relative humidity within the room.

In accordance with this invention, floating wick assembly 9 is provided with one or more replaceable wick cartridges, as generally indicated at 35. As shown in FIG. 1, two such wick cartridges 35 are installed in openings between the side walls 15, the end wall 17, and the top wall 19 at opposite ends of the floating wick assembly in such manner that substantially all of the air drawn through flow path F by fan 23 must pass through the two wick cartridges. It will be understood, however, that within the broader aspects of this invention, only a single wicking element need to be provided.

Each wick cartridge 35 includes a wick element or core 37 formed of a suitable sheet-like, absorbent capillary wick material, as will be hereinafter discussed in greater detail, which is in contact with liquid water W within reservoir tank 3 such that the wick element will absorb the water and, by capillary attraction, will pull the water vertically above the level WL of the water within the tank so as to substantially wet the entire surface area of the wick element. The surface area of wick element 37 above water level WL so wetted is referred to as the evaporative area EA of the wick element. In this manner, air drawn through flow path F by fan 23 comes into close evaporative contact with substantially the entire evaporative area of the wick element thereby to enhance the evaporative characteristics of the wick element.

Figure 2:
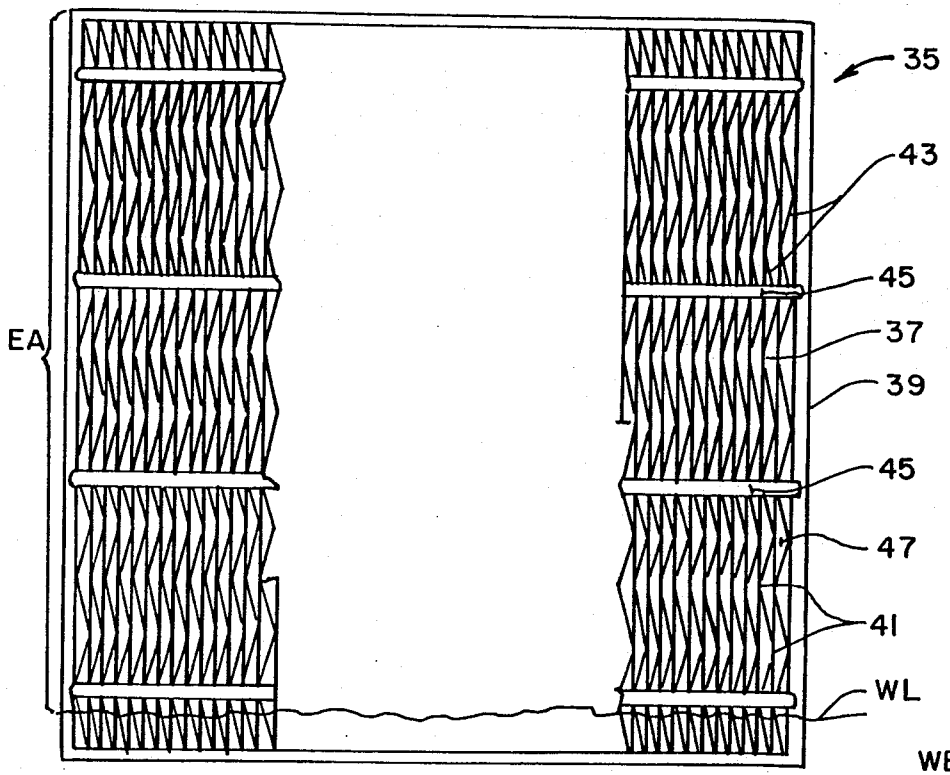
FIG. 2 is a front end elevational view of a wicking element of the present invention as it is installed in the humidifier shown in FIG. 1 having a core of suitable sheet wicking media, with the lower portion of the core immersed in a supply of water, as indicated by the water level, thereby to wet the evaporative area of the core by means of capillary absorption of the water through the wicking media.

Each wick cartridge 35 may include an optional, outer wick element frame 39 which surrounds the wick element or core 37. The latter comprises a plurality of substantially parallel, vertical wick plates 41 having optional angled wick ribs 43 therebetween. As indicated in FIG. 2, a plurality of generally parallel spacers 45 may be utilized to interconnect the outer margins of the wick plates 41 and the wick ribs 43 so as to positively hold the plates and ribs in desired spaced relation to one another. However, it will also be understood that if a wick element frame 39 is utilized, the spacers 45 may not be required, inasmuch as the wick frame will hold the wick plates and wick ribs in desired spaced relation relative to one another. As shown in FIG. 2, the parallel, vertical wick plates 41 and the angled wick ribs 43 define a plurality of generally triangular-shaped wick passageways 47 which extend axially (i.e., horizontally) through wick element 37, and which brings air passing therethrough into intimate contact with the wetted surface areas of wick element 37.

Figure 3:
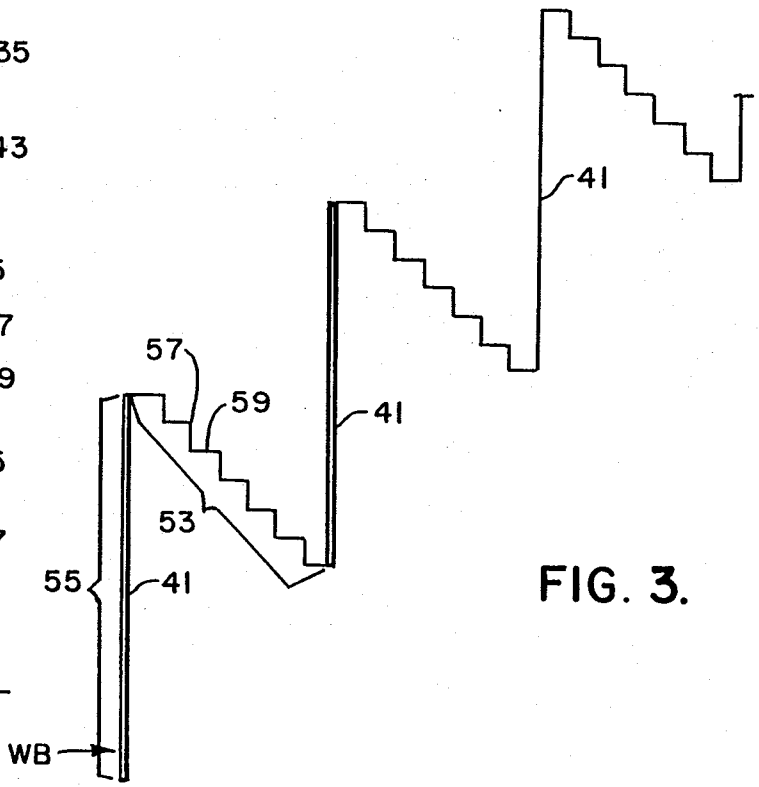
FIG. 3 is an edge view of a web of wicking media after having been formed in a suitable pleating apparatus (not shown) thereon so as to constitute parallel plates, with the areas between the plates being pleated such that the pleated areas form a plurality of angled ribs between the plates.

Referring now to FIG. 3, the manner in which wick elements 37 are formed will now be disclosed in detail. Preferably, wick element 37 is formed of a unitary web WB of non-woven, fibrous, absorbent wicking media that will maintain its shape and physical properties when in contact with liquid water for extended periods of time. This material is selected to have a sufficient absorption capacity and sufficient capillarity such that with only the bottom portion of wicking element 37 submerged below water level WL as shown in FIG. 2, the wick element will absorb water and will wick the water vertically by capillary action along the entire height of the vertical, parallel wick plates 41 and the angled wick ribs 43 extending above water level WL so that the entire evaporative area EA of wicking element 37 is substantially uniformly wetted.

The web WB of the above-described wicking media paper is unrolled and fed into a suitable pleating machine (not shown) in which sections of the web, as indicated at 53, are pleated and which in other sections, as indicated at 55, are left uncorrugated such that the web has a series of intermittent pleated sections 53 and uncorrugated sections 55. Web WB preferably has corrugations (not shown) running longitudinally thereof for added stiffness. Specifically, the pleats of section 53 include a plurality of crease parallel lines 57. These crease lines 57 define pleats 59 which, as will hereinafter appear, form ribs 43.

By compressing the parallel plates 41 toward one another, pleats 59 formed in the rib sections 53 will become longer while the plates 41 remain parallel to one another, with the rib creases 57 coming into contact with the vertical faces of two adjacent plates 41. Thus, the one-piece wick element 37 will assume its configuration, generally as shown in FIG. 2.

With the wicking web WB so corrugated, pleated, and compacted, the wick plates 41 and the angled wick ribs 43 may be positively held in desired spaced relation to one another by applying spacers 45 thereto. Additionally, the optional wick element frame 39 may be applied to the outer periphery of the wick element to aid in holding the wick element in its desired folded configuration, with wick plates 41 generally parallel to one another and with wick ribs 43 contacting two adjacent parallel wick plates and extending at an angle therebetween, as shown in FIG. 2.

In accordance with this invention, it is preferred that spacers 45 be formed of a hardenable liquid synthetic resin material, such as a hot-melt adhesive or the like, which is applied in the form of a liquid bead to the edges of wick plates 41 and wick ribs 43 while the wick element 37 is held in its desired folded and compressed condition. Upon hardening of the hardenable liquid beads, the respective edges of the wick plates 41 and wick ribs 43 are positively adhered to spacer ribs 45 and the now hardened spacer ribs positively hold the margins of the wick plates and the wick ribs to one another.

In accordance with this invention, wick cartridges 35 may be readily inserted into and readily removed from floating wick assembly 9. This may be accomplished by lifting the removable louver assembly LA from reservoir tank 3 so as to provide ready access to the wick cartridges 35 from above. The wick cartridges merely may be lifted from between side walls 15 and end wall 17 of wick assembly 9 for cleaning or replacement.

Additionally, humidifier 1 of the present invention may include suitable controls, as indicated at C, including an on/off switch and an optional humidifier for automatically turning on humidifier 1 when the relative humidity within a room drops below a predetermined level, and for automatically turning off the humidifier when the relative humidity within the room exceeds another predetermined level. These controls may be wired in a conventional manner relatively apparent to those skilled in the art to control operation of fan 23 which in turn is the only powered or movable element of humidifier 1. It is to be understood that these controls may be conventional and do not, per se, constitute a part of this invention.

In operation, a homeowner preferably removes louver assembly LA and fills the reservoir tank 3 to a predetermined level with water. This filling operation may be carried out by pouring water from a bucket into the tank. Preferably, the reservoir tank may hold a convenient quantity of water (e.g., 7 gallons) when full. The louver assembly LA is then replaced on the top of reservoir tank, an the humidifier controls C are operated so as to energize fan 23.

With the water level WL at its full mark relatively high within tank 3, the floating wick assembly 9 will be in relatively close proximity to the undersurface of fan frame 25, and the extensible/collapsible duct 33 will be in its collapsed position, substantially as shown in FIG. 1. As heretofore noted, floating wick assembly 9 is so structured that it will, at all times, float within the supply of water W contained in reservoir tank 3 such that a uniform water level WL is maintained in operative association with the lower portion of wick elements 37 of wick cartridges 35 thereby to maintain the lower regions of the wick elements in contact with liquid water. This ensures that the wick element absorb water from the water supply and wick the water vertically within the absorptive, capillary absorptive paper constituting the wick elements so as to substantially, uniformly wet wick plates 41 and wick ribs 43.

Operation of fan 23 draws room air downwardly into reservoir tank 3 via the outer end margins of louver assembly LA such that the air enters the outer, generally vertical faces of wick cartridges 35 and such that the air passes through the wick passages 47 of wick elements 37 so as to be in intimate contact with the wetted surface areas of wick plates 41 and wick ribs 43. This ensures that evaporation of water from the wetted wick plates and wick ribs is facilitated as the air is drawn through the wick element. Air, with increased moisture content, is drawn through the wick cartridges, through floating wick assembly 9, and through the extensible/collapsible duct 33, and is discharged upwardly through venturi 27 into the room through the center portion of the louver assembly LA. In this manner, increased moisture content air is discharged into the room by humidifier 1 of the present invention thus increasing the relative humidity within the room.

It will be particularly noted that many advantages are derived from the humidifier and wick element construction of the present invention. First, as noted above, fan 23 is the only powered or movable element of humidifier 1. There is no requirement for motor powered pumps, rotary belts, or rotary evaporative disks. Further, it will be noted that by providing a floating wick assembly 9, the wick assembly rises and falls with the water level within reservoir tank 3 such that water level WL is maintained at a constant position relative to the floating wick assembly thus ensuring that a uniform portion of the wicking element remains in contact with liquid water, as illustrated in FIG. 2. Further, a substantially uniform and predetermined amount of the wicking element extends up above water level WL and constitutes a constant evaporative area EA for the wicking element. This ensures that the wetted surface area of wicking element 37 remains substantially constant, regardless of the rise and fall of the water level within reservoir tank 3.

Still further, by providing the extensible/collapsible duct 33 interconnecting the floating wick assembly 9 and the stationary fan mounting frame 27, the wicking assembly is free to rise and fall with the water level without any substantial interference while permitting a closed flow path F through the wetted wicking elements to the fan. Still further, the above-described construction of wicking cartridges 35 permits the wick cartridges to be readily removed from the floating wick assembly 9 for cleaning or replacement.

It is also pointed out that the construction and operation of humidifier 1 of the present invention maximizes the evaporative characteristics of the wicking elements without causing the formation of undue deposits of minerals within tank 3 and on other portions of the humidifier 1 (except wick elements 37), and without discharging mineral deposits therefrom into the room via fan 23. Because mineral deposits (both soluble and insoluble) are retained on the wick elements 37 without reintroduction into water W in tank 3, the humidifier construction herein described substantially prevents the concentration of soluble minerals contained within the water supply, and also substantially prevents insoluble minerals from falling clear of floating wick assembly 9 and accumulating in the bottom of reservoir tank 3. It will be recognized that as water is wicked upwardly by wick plates 41 and wick ribs 43 of wick element 37, and as the water is evaporated therefrom, minerals dissolved in or carried by the water will be deposited on the surfaces of the wick element. Of course, over time, the accumulation of such soluble and insoluble minerals on the surfaces of the wicking element will cause the evaporative efficiency of the wicking element to drop.

For example, the humidifier 1 of the present invention may utilize wick cartridges 35 having a height of about five inches, a width of about ten inches, and a depth of about five inches, such that wicking element 37 of each such cartridge has a total surface area of about 24.3 square feet. The humidifier 1 may use two such wick cartridges 35 at each end of floating wick assembly 9. Such a humidifier will evaporate about 14 gallons of water per 24-hour period in a room having a dry bulb temperature of 70° F., and a relative humidity of about 30 percent. However, after such a humidifier 1 of the present invention has evaporated approximately 400 gallons of water of a medium hardness, comparable to the domestic water supply of St. Louis County, Mo., the evaporative efficiency of the humidifier will be reduced to evaporating and discharging about seven gallons per 24-hour day. It is recommended that when the evaporative efficiency of the humidifier drops from about 14 gallons per day to about five gallons per day, the wicking cartridges 35 should either by cleaned or replaced.

In order to clean or replace wicking cartridges 35, the louver assembly LA is lifted clear of tank 3, and the wicking cartridges 35 may be readily removed from the floating wick assembly 9 merely by grasping the wick cartridges and lifting them from the floating wick assembly. The wick elements 37 of the wick cartridges may then be washed in another supply of suitable water or under running tap water. This will tend to dislodge both water soluble and water insoluble mineral deposits from the surfaces of the wick element. The washed wick cartridge may then be replaced within the floating wick assembly and the louver assembly may be reinstalled. It has been found that such washing of the wick assembly will restore the wicking elements to about 90 percent of their original evaporative capacity such that the humidifier 1 of the present invention will evaporate about 13.5 gallons of water per day. This washing or cleaning of the wick elements permits reuse of the wick elements.

Further, those skilled in the art will recognize that since water from within the reservoir tank is wicked upwardly in a continuous fashion to the wick element 37, and since the evaporative areas EA of the wick element on which the soluble and insoluble minerals contained in the water accumulate do not come into contact with the liquid water supply within reservoir tank 3, the washing or changing of the wicking element removes the mineral deposits from humidifier 1 without the reintroduction of the mineral deposits into the supply of water W contained within the reservoir tank. In this manner, the water contained in reservoir tank 3 has concentrations of soluble minerals therein substantially similar to the fresh water which is periodically added to the reservoir tank. Insoluble mineral deposits are not introduced into the water tank from the wicking elements such that they accumulate on the sides and bottom of the water tank, thus necessitating cleaning of the tank.

Figure 4:
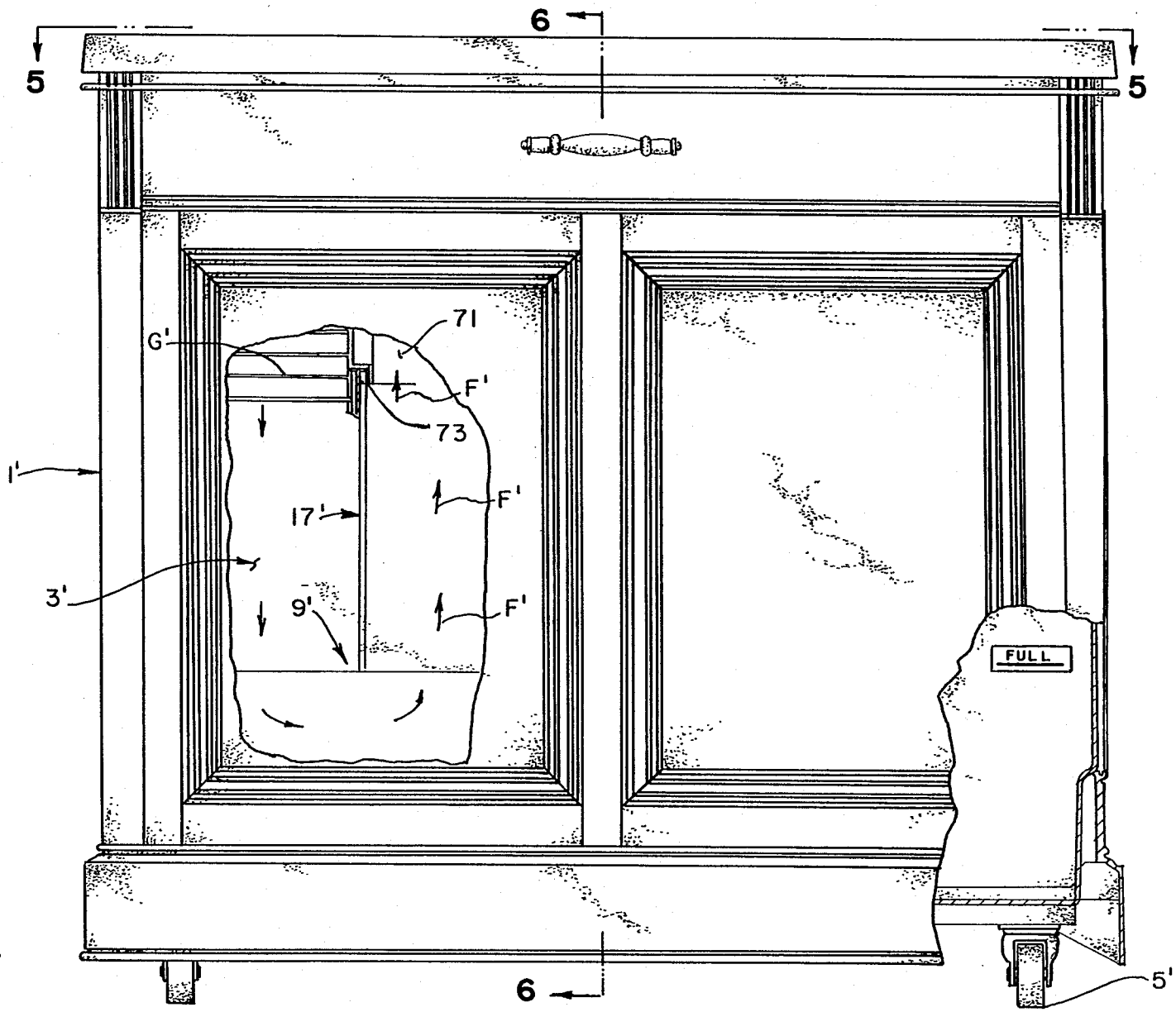
FIG. 4 is a front elevational view of another embodiment of a humidifier of the present invention with parts of its cabinet broken away to show details of its construction.
Figure 5:
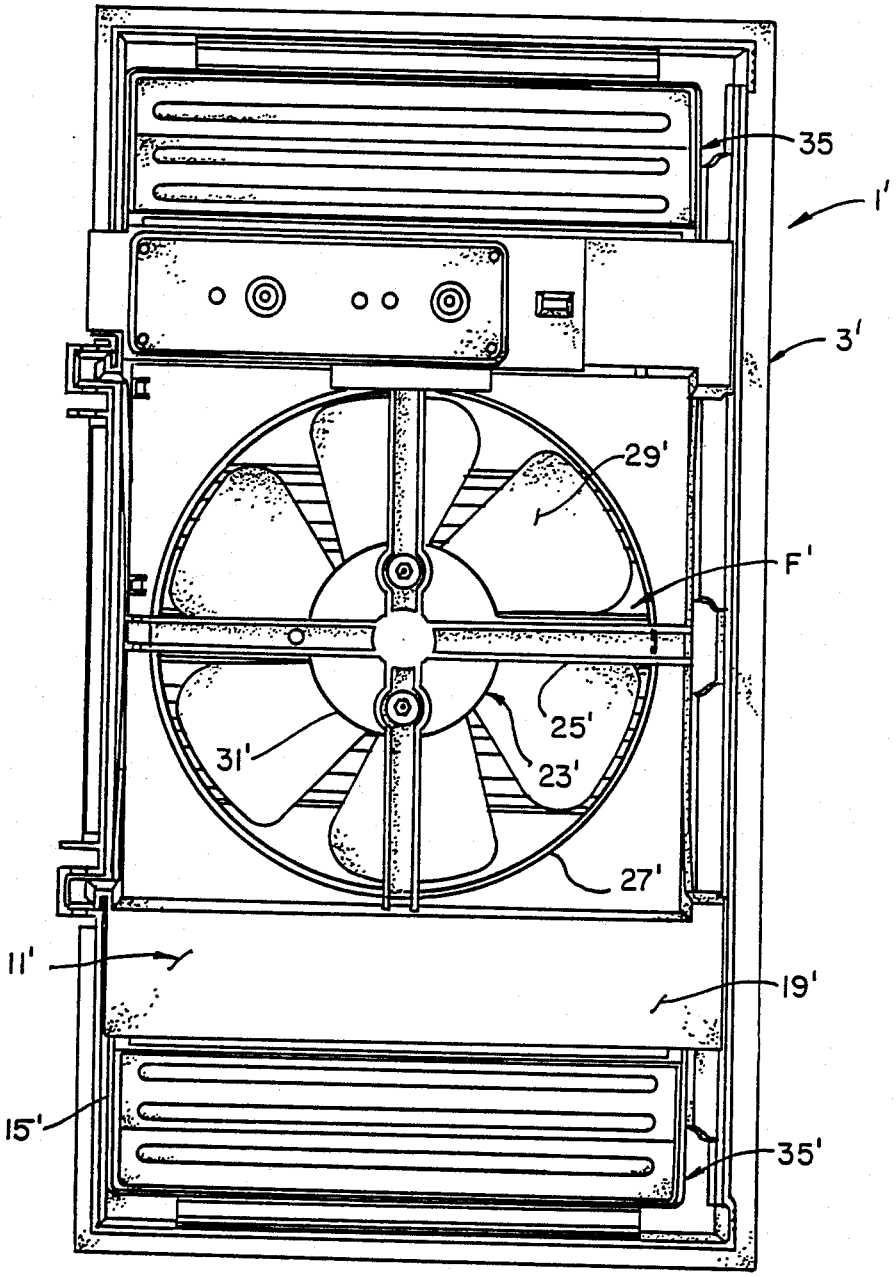
FIG. 5 is a top plan view taken along line 5—5 of FIG. 4 with the top of the humidifier removed.
Figure 6:
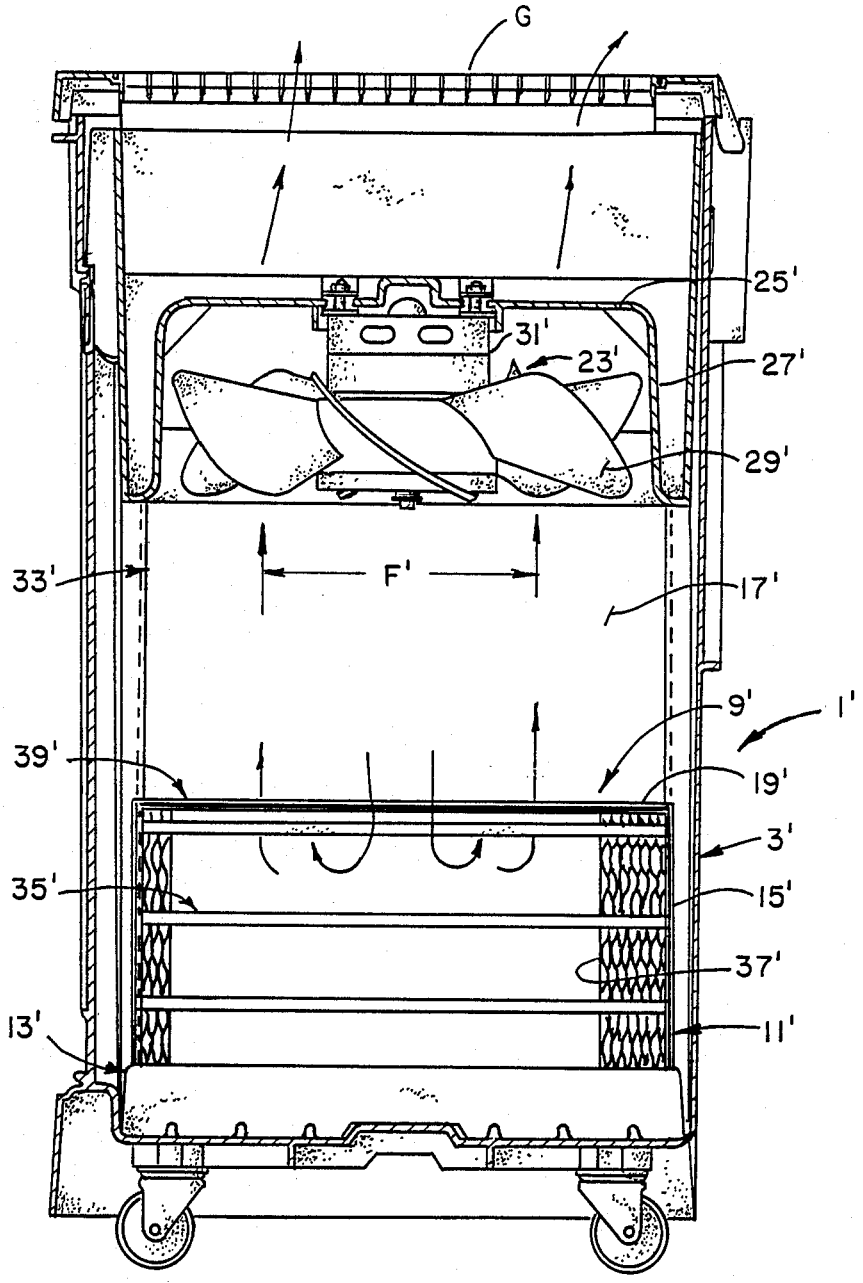
FIG. 6 is a vertical cross section taken along line 6—6 of FIG. 4.

Referring now to FIGS. 4–6, another embodiment of the humidifier of the present invention is indicated in its entirety by reference character 1'. Humidifier 1' comprises a reservoir tank 3, mounted on casters 5'. A floating wick assembly, as generally indicated at 9', is disposed within reservoir tank 3' and is free to float within tank 3' and, more specifically, to rise and fall with the water level within the tank between a raised position when the tank is full and lowered position when the tank is empty.

More specifically, the floating wick assembly 9' comprises a wick frame or body 11' having a buoyant base 13'. Side walls 15' extend up from the base. Wick assembly 9' has vertical grooves (not shown) which cooperate with inwardly extending vertical rails on the inside of tank 3' (also not shown) which guide the wick assembly, and, at least in part, seal the wick assembly with respect to tank 3' along the sides of the wick assembly. End walls 17' spaced inwardly of the ends of the wick housing 11' extend vertically, with the top wall 19' extending horizontally, as in FIG. 1, to close of the top of the wick housing between wick element 37' and end wall 17', except in the flow path F' within wick housing 11'.

Venturi 27' has a downwardly extending, stationary venturi wall 71, as is best shown in FIG. 4. This downwardly extending venturi wall 71 is disposed inside the upperwardly extending end walls 17' and carries a gasket 73 on its lower end with the stationary gasket 73 slideably, sealingly engaging the inner face of the upwardly extending end wall 17' of the movable wick assembly 9' thereby to effectively seal the upper portion of the wick frame or housing 11' with respect to venturi 27', and yet to permit the wick assembly 9' to freely rise and fall with the level of the water within reservoir tank 3'. It will be understood that the relatively close, sliding fit of the moveable wick assembly 9' within tank 3' seals the sides of the wick assembly as it moves vertically with respect to venturi 27'.

As shown best in FIG. 5, wick cartridges 35' extend out beyond top walls 19' such that the replaceable wick cartridges 35' may be readily lifted from wick housing 11' for cleaning or replacement.

In operation, the FIGS. 4–6 embodiment operates similar to the FIGS. 1–3 embodiment with the venturi wall 71 slideably engaging, through gasket 73, the end walls 17' of the wick frame 11', instead of using the extensible/collapsible duct 33 of the FIGS. 1–3 embodiment. Thus, with reservoir filled with water so that the water level is approximately the full mark indicated within tank 3', as shown in FIG. 4, the buoyant base 13' of wick frame 11' is at an uppermost or elevated position within the tank, and the upper end of end walls 17' of wick frame 11' are raised upwardly relatively to the downwardly extending venturi wall 71 such that the venturi wall 71 is telescopically received within the side and end walls 15' and 17', respectively. Upon fan motor 31' being energized, fan blades 29' draw relatively dry air into the tank through the upper grill G down into the reservoir tank and through a grill (not shown) on the back of the tank. The dry air is then drawn in through the outwardly facing vertical surfaces of wick cartridges 35' at each end of floating wick assembly 9' so as to be brought into evaporative contact with the wetted surfaces of wick cartridge 35 much in the manner heretofore described. The wetted air is then drawn into the interior of floating wick assembly 9' and is drawn upwardly within end walls 17' by the fan blades 29' within venturi 27' to be discharged vertically through grill G into the room. As water is evaporated from within reservoir tank 3' and as the water level falls, the floating wick assembly 9' will move downwardly with the level of the water and the end walls 17' of the wick assembly sliding downwardly with respect to the fixed gasket 73 and with respect to the fixed downwardly extending venturi walls 71, while maintaining an air seal between top walls 19' of floating wick assembly 9' and the downwardly extending venturi walls 71, around the flowpath F'.

In view of the above, it will be seen that the other objects of this invention are achieved and other advantageous results obtained.

As various changes could be made in the above constructions and methods without departing from the scope of the invention, it is intended that all matter contained in the above description or shown in the accompanying drawing shall be interpreted as illustrative and not in a limiting sense.

What is claimed is:

1. A humidifier comprising a water reservoir tank for holding a supply of water, an evaporator floatable on said water, said evaporator having a horizontally disposed wick element extending across at least two opposite areas of said water reservoir and being freely and independently floatable in operative association with the water, said wick element having an evaporative surface extending above the level of the water, said wick element being constructed such that said evaporative surface extends a substantially uniform and predetermined amount above said water level as said water level in said tank rises and falls to provide a constant evaporative area for said wicking element, said humidifier further comprising a fan in fixed position with respect to an upper end of said reservoir tank, said fan being operated to draw air downwardly into contact with said wick element, an extensible and collapsible closed flow path means between said wick element and said fixedly mounted fan enabling said fan to also draw air upwardly through said closed flow path means from over substantially the entire evaporative surface and constant evaporative area of said wick element so as to discharge air from said humidifier with increased relative humidity while accommodating downward and upward movement of said freely and independently floatable wick element with the fall and rise of the water level within said reservoir tank, and said wick element having a core of sheet wicking material, said core comprising a plurality of spaced, parallel plates and a plurality of inclined ribs extending between said parallel plates, with said plates and said ribs defining air passageways extending through said core, said plates and said ribs being of a one-piece folded web, said plates extending substantially vertically when said wick element is installed in said evaporator, with the lower portion of said plates and said ribs being at least in part immersed within said water, and with the portion of said core extending above said water constituting the constant evaporative area of said wick element.

2. A humidifier as set forth in claim 1 wherein said flowpath means comprises an extensible and collapsible duct between said fan and said evaporator thereby to permit said evaporator to rise and fall relative to the fan as it floats on said water as said water level rises and falls relative to said reservoir tank.

3. A humidifier as set forth in claim 2 wherein said fan has venturi walls surrounding said fan and extending downwardly and constituting a portion of said duct, said duct further comprising walls extending upwardly from said evaporator and telescopically mounted with respect to said downwardly extending venturi walls.

4. A humidifier as set forth in claim 3 wherein a gasket is interposed between said downwardly extending venturi walls and said upwardly extending evaporator walls for a sliding, sealing fit therebetween.

5. A humidifier as set forth in claim 1 wherein said wick element is a cartridge which may be readily removed from and installed in said evaporator as a unit.

6. A humidifier as defined in claim 5 wherein said replaceable wick element is mounted upon a floatable base within said water reservoir tank, said relaceable wick element extending substantially across said reservoir tank but being sufficiently spaced therefrom to allow said wick element to be removed and replaced along the interior of said water reservoir tank relative to said floatable base.

7. A humidifier as set forth in claim 1 wherein said wick element has means for positively holding said parallel spaced plates in desired space relation.

8. A humidifier as set forth in claim 7 wherein said holding means comprises a bead of a suitable, hardenable material applied as a liquid to the outer edges of said plates and ribs thereby to bridge between said plates and ribs and, upon hardening, to hold said plates and ribs in desired spaced relation relative to one another.

9. A humidifier as set forth in claim 8 wherein said core is surrounded least in part, by a frame, said core and said frame constituting said wicking cartridge which may readily be removed from and inserted into said wicking assembly.

* * * * *

UNITED STATES PATENT AND TRADEMARK OFFICE

CERTIFICATE OF CORRECTION

PATENT NO. : 4,822,533

DATED : April 18, 1989

INVENTOR(S) : Robert E. Steiner and Terrence L. Stanek

It is certified that error appears in the above-identified patent and that said Letters Patent is hereby corrected as shown below:

Column 3, line 34, "provisinn" should be ---provision---.

Column 10, line 35, "tank 3" should be ---tank 3'---.

Column 10, line 52, "of" should be ---off---.

Column 12, line 46, "relaceable" should be ---replaceable---.

Signed and Sealed this

Third Day of April, 1990

*Attest:*

HARRY F. MANBECK, JR.

*Attesting Officer*

*Commissioner of Patents and Trademarks*